US011933003B2

(12) United States Patent
Delot

(10) Patent No.: US 11,933,003 B2
(45) Date of Patent: Mar. 19, 2024

(54) BEAM CONNECTION DEVICE

(71) Applicant: HILL & SMITH LIMITED, Wolverhampton (GB)

(72) Inventor: Jeremy Delot, Wolverhampton (GB)

(73) Assignee: HILL & SMITH LIMITED, Wolverhampton (GB)

( * ) Notice: Subject to any disclaimer, the term of this patent is extended or adjusted under 35 U.S.C. 154(b) by 597 days.

(21) Appl. No.: 16/949,166

(22) Filed: Oct. 16, 2020

(65) Prior Publication Data

US 2021/0115635 A1 Apr. 22, 2021

(30) Foreign Application Priority Data

Oct. 17, 2019 (GB) ..... 1915040

(51) Int. Cl.
*E01F 15/04* (2006.01)

(52) U.S. Cl.
CPC ..... *E01F 15/0423* (2013.01); *E01F 15/0415* (2013.01); *E01F 15/0461* (2013.01)

(58) Field of Classification Search
CPC ..... E01F 15/0415; E01F 15/0423; E01F 15/0438; E01F 15/0461; E01F 15/06; E04H 17/1447; E04H 17/1448; E04H 17/1452; E04H 17/1456; E04H 17/1488; Y10T 403/32008; Y10T 403/32057; Y10T 403/32073; Y10T 403/32091; Y10T 403/32163
See application file for complete search history.

(56) References Cited

U.S. PATENT DOCUMENTS 2,181,703 A * 11/1939 McCracken ..... E01F 15/0461 256/13.1
4,075,473 A * 2/1978 Winston ..... E01F 15/025 404/6
4,739,971 A * 4/1988 Ruane ..... E01F 15/0438 248/66

(Continued)

FOREIGN PATENT DOCUMENTS

DE 4031781 A1 4/1991
EP 0698689 A1 * 2/1996 ..... E01D 19/103

(Continued)

OTHER PUBLICATIONS

Intellectual Property Office of the United Kingdom, Search Report dated Nov. 25, 2019 issued In priority application, British Application No. GB1915040.8.

(Continued)

*Primary Examiner* — Josh Skroupa
*Assistant Examiner* — Kevin J Baynes
(74) *Attorney, Agent, or Firm* — Gottlieb, Rackman & Reisman, PC

(57) ABSTRACT

Disclosed is a barrier, comprising: a plurality of posts; a first beam and a second beam arranged in an end-on relation to one another and extending between respective posts of the plurality of posts, wherein the first beam and second beam are longitudinally displaceable with respect to one another; and, an articulating link connecting the first beam and the second beam, wherein the articulating link translates a longitudinal movement of the first beam in a first direction to a longitudinal movement of the second beam in a second direction.

20 Claims, 4 Drawing Sheets

(56) References Cited

U.S. PATENT DOCUMENTS

| | | | | | |
|---|---|---|---|---|---|
| 4,838,523 | A * | 6/1989 | Humble | F16F 7/127 | 248/66 |
| 6,036,399 | A * | 3/2000 | Schalk | E01F 15/0423 | 404/9 |
| 7,530,548 | B2 * | 5/2009 | Ochoa | E01F 15/0423 | 404/6 |
| 7,800,515 | B2 * | 9/2010 | Chen | E01F 15/0423 | 340/815.45 |
| 8,424,849 | B2 * | 4/2013 | James | E01F 15/025 | 256/13.1 |
| 8,491,216 | B2 * | 7/2013 | Dyke | E01F 15/146 | 404/6 |
| 8,966,680 | B2 * | 3/2015 | Dowd | A47D 13/063 | 5/98.1 |
| 8,992,116 | B2 * | 3/2015 | Sloan | E04H 17/127 | 404/6 |
| 9,200,417 | B2 * | 12/2015 | Leonhardt | E01F 15/0423 | |
| 10,378,165 | B2 * | 8/2019 | Dyke | E01F 15/0423 | |
| 2008/0224114 | A1 * | 9/2008 | Cheng | E01F 15/0453 | 256/19 |
| 2018/0327985 | A1 * | 11/2018 | Lawler | E01F 15/0453 | |

FOREIGN PATENT DOCUMENTS

| | | | | |
|---|---|---|---|---|
| EP | 1832681 | A1 * | 9/2007 | E01F 15/025 |
| KR | 100855231 | B1 | 9/2008 | |
| KR | 20090087215 | A * | 8/2009 | E01D 19/103 |
| KR | 20140095870 | A * | 8/2014 | E01F 15/02 |
| KR | 20140095870 | A | 8/2014 | |
| KR | 20150004210 | A * | 1/2015 | E01F 15/02 |
| KR | 101710167 | B1 | 2/2017 | |
| KR | 20170124037 | A | 11/2017 | |
| KR | 101835121 | B1 | 3/2018 | |
| KR | 20180036933 | A | 4/2018 | |
| WO | WO-9936630 | A1 * | 7/1999 | E01D 19/103 |
| WO | 2005028757 | A1 | 3/2005 | |
| WO | 2019/116400 | A1 | 6/2019 | |

OTHER PUBLICATIONS

European Patent Office, Extended European Search Report dated Mar. 22, 2021 issued in foreign counterpart application, European Patent Application No. 20202189.5 filed Nov. 24, 2015.

* cited by examiner

BEAM CONNECTION DEVICE

FIELD OF INVENTION

The invention relates to a barrier for obstructing the path of vehicle. In particular, though not exclusively, the invention relates to a barrier for use in a hostile vehicle mitigation scenario.

BACKGROUND

Various types of road barrier are known for partitioning a vehicle roadway from prohibited areas, such as pavements, public spaces and buildings. Some barriers are specifically designed to be used for hostile vehicle mitigation, HVM, situations in which they need to withstand vehicle ram attacks or vehicle bourn improvised explosive devices, for example. Such barriers are generally concerned with limiting the progression of a vehicle which purposely tries to breach the barrier and are consequently designed to withstand higher energy impacts than conventional road barriers. It is also the case that HVM barriers are generally deployed in public spaces with an implicit requirement not to be too obstructive, either visually or physically.

The present invention seeks to provide an improved connection for use in a barrier.

SUMMARY

The present invention provides a barrier and a barrier connection according to the appended claims.

The present disclosure provides a barrier, comprising: a plurality of posts; a first beam and a second beam arranged in an end-on relation to one another and extending between respective posts of the plurality of posts, wherein the first beam and second beam are longitudinally displaceable with respect to one another; and, a articulating link connecting the first beam and the second beam, wherein the articulating link translates a longitudinal movement of the first beam in a first direction to a longitudinal movement of the second beam in a second direction.

The beam may be elongate having a longitudinal axis. The first direction and second direction may be opposite to one another and in-line with the longitudinal axis of the first and second beam.

The articulating link may comprise a connection plate which extends between and is connected to the first and second beam.

The connection plate may be connected to each of the first beam and second beam via a connection pin.

One or more of the posts may include a receiving portion for receiving a terminal end of each of the first and second beams.

The receiving portion may comprise a lateral sidewall against which the respective terminal end of the first and second beam abuts during an impact to prevent a lateral separation of the post and beam.

The articulating link may comprise a first connection plate and a second connection plate located on opposing sides of the beam.

The first connection plate may be located above the second plate.

The first and/or second connection plate may include an aperture for receiving the connection pin.

The aperture may be elongate having a longitudinal axis which extends transversely with respect to the longitudinal axis of the first and second beam.

The elongate aperture may be curved.

Either or both of the first and second beam may comprise a reinforcement member which extends between respective first and second ends of the first and second beams.

The reinforcement member may comprise a wire rope.

The beam may comprise an exterior wall defining an internal cavity. The reinforcement member may be located within the internal cavity.

The posts may be vertical and installed within a subterranean footing.

The posts may have a terminal end which is distal to the ground and the first and second beams are located towards the terminal end of the respective post.

The reinforcement member may be attached to a carriage located within the beam. The connection pin may engage with the carriage. The carriage may be floating so as to be connected to the beam only via the connection pin. The carriage may be attached to two reinforcement members.

The reinforcement members may be spaced equidistantly on either side of the connection pin.

The beam may be incorporated in a panel.

The present disclosure also provides a connection for connecting a first beam and a second beam. The connection may comprise a first connecting pin for being received by the end of a first beam and a second connecting pin for being received by the end of a second beam. A connection plate according to any example described herein. The connection may be provided as a kit of parts.

The skilled person will appreciate that except where mutually exclusive, a feature described in relation to any one of the aspects, examples or embodiments described herein may be applied to any other aspect, example, embodiment or feature. Further, the description of any aspect, example or feature may form part of or the entirety of an embodiment of the invention as defined by the claims. Any of the examples described herein may be an example which embodies the invention defined by the claims and thus an embodiment of the invention.

BRIEF OVERVIEW OF FIGURES

The invention will now be described, by way of example only, with reference to the accompanying drawings, in which.

DETAILED DESCRIPTION

Figure 1:
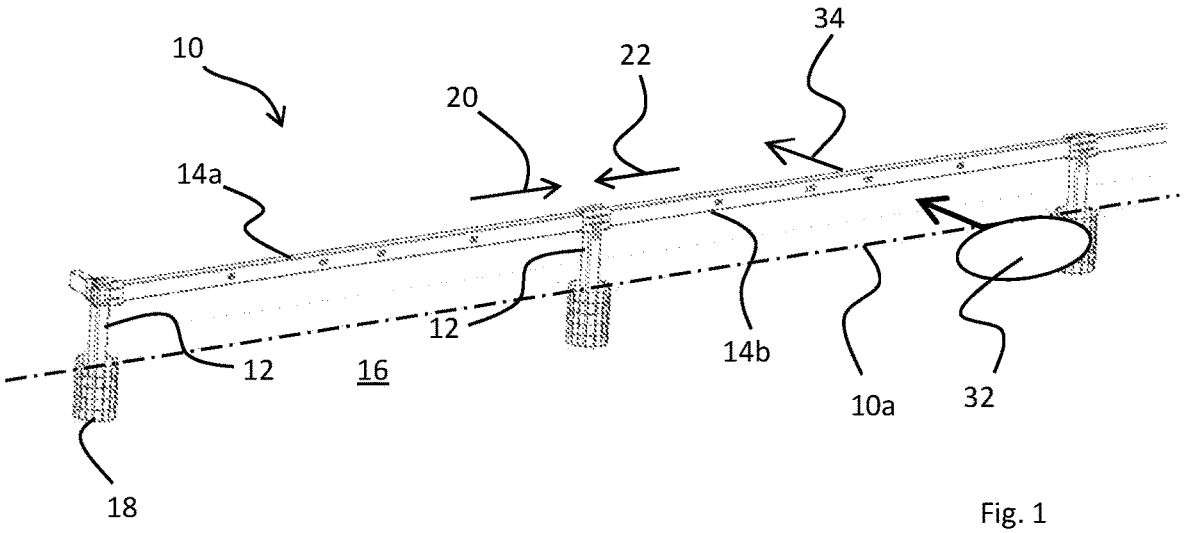
FIG. 1 shows a barrier comprising a plurality of posts and beams.

FIG. 1 shows a barrier 10 comprising a plurality of posts 12 and beams 14*a*, 14*b*. The barrier 10 is generally intended for use in hostile vehicle mitigation scenarios but this is not a limitation and the barrier 10 may be used in other situations to segregate a roadway (or vehicle accessible area) from a surrounding area where the passage of vehicle is either prohibited or controlled access is required.

The posts 12 are distributed in a linear array along a barrier line 10*a*. The posts 12 may be separated by a common distance so as to be evenly distributed along the line 10*a* of the barrier 10 but this need not be the case. The line of the posts 12 which defines the barrier line 10*a* will typically be straight but may be curved in some situations. Further, the barrier 10 may comprise one or more turns such as the corner shown to the left hand side of FIG. 1. The number of posts 12 is dictated primarily by the layout and extent of the barrier 10 and the permissible separation which the beams 14*a,b* can span. For the purposes of this disclosure, a termination comprising a single post 12 having a connection with a first beam 14*a* and a second beam 14*b* is described but it will be appreciated that such terminations may be provided at all or some of the posts 12 within a barrier system.

The barrier 10 is located at a required site with the posts 12 implanted within the ground 16 and received within a suitable footing to provide the required anchorage necessary to impede and limit the penetration of a vehicle. The footing may be any suitable structure such as a subterranean pre-cast or poured concrete block 18, as depicted in FIG. 1.

The beams 14*a,b* extend from a first end to a second end between adjacent posts 12. Thus, each post 12 may receive a terminal end of a first beam 14*a* and terminal end of a second beam 14*b*. It will be appreciated that in some examples there may be intermediate posts 12 which are located at a mid-portion of a beam 14*a,b*.

The beams 14*a,b* may be elongate members having a longitudinal axis which defines the barrier line 10*a*. The posts 12 may be elongate having a footing end proximal to or submerged in the ground 16, and a terminal end which is distal to the ground 16. Although only one line of beams 14*a,b* is shown in FIG. 1, it will be appreciated that some barriers may incorporate multiple lines of beams 14*a*, 14*b*. A line beams may be located centrally with respect to the vertical axis of the posts 12 and/or on either or both sides of the posts and/or attached to the posts at a mid-height position, towards the ground, or any combination of these.

Either or both of the beams 14*a,b* may be attached to the posts 12 in such a way that they are longitudinally displaceable. Hence, either or both of a first and a second beam may be moved along the longitudinal axis of the beam 14*a,b* and relative to the post during installation and/or a vehicle impact. As such, the first and second beams 14*a,b* may be slidably attached to the posts 12. The longitudinal movement may be in a first direction 20 and/or second direction 22.

It should be noted that the use of the terms first and second beams 14*a,b* is arbitrary and other terms may be used. For example, it may be convenient to refer to the first and second beams 14*a,b* as a deflecting beam and a slave beam in which the deflecting beam is the one being directly moved by an external force, such as an impacting vehicle, with the other being moved by the deflecting beam in a slave-like manner via an articulating link which is described below.

Figure 4A:
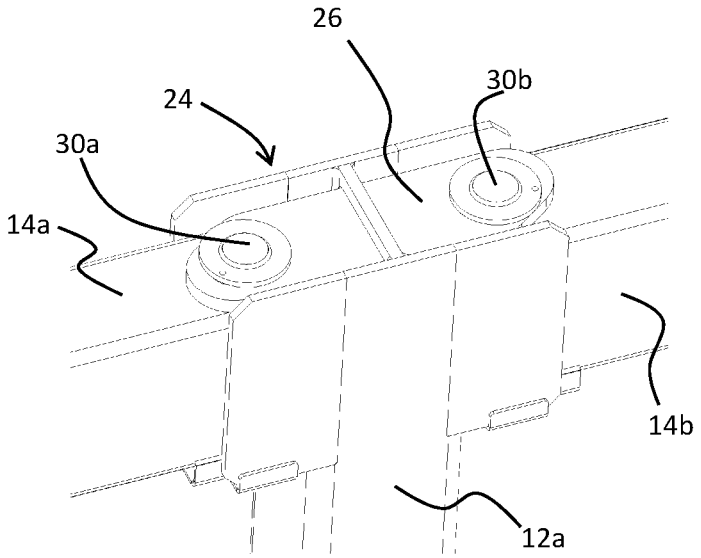
FIGS. 4A, 4B and 4C show different positions of beams relative to a post.
Figure 4B:
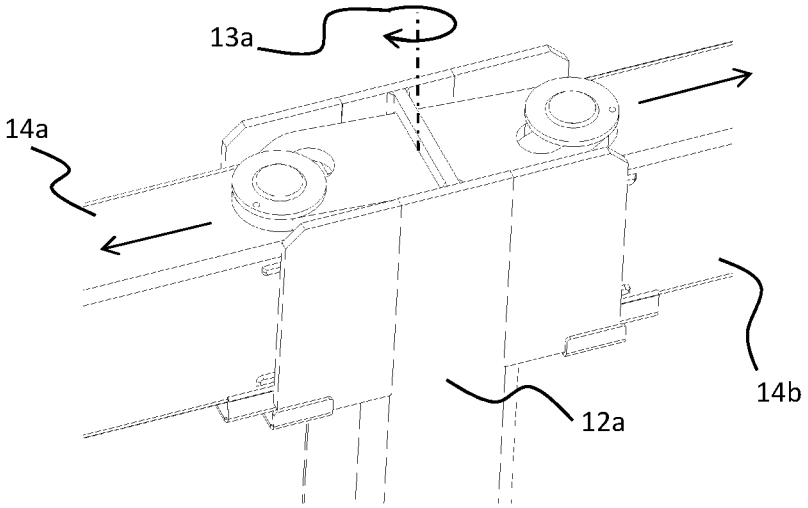
Figure 4C:
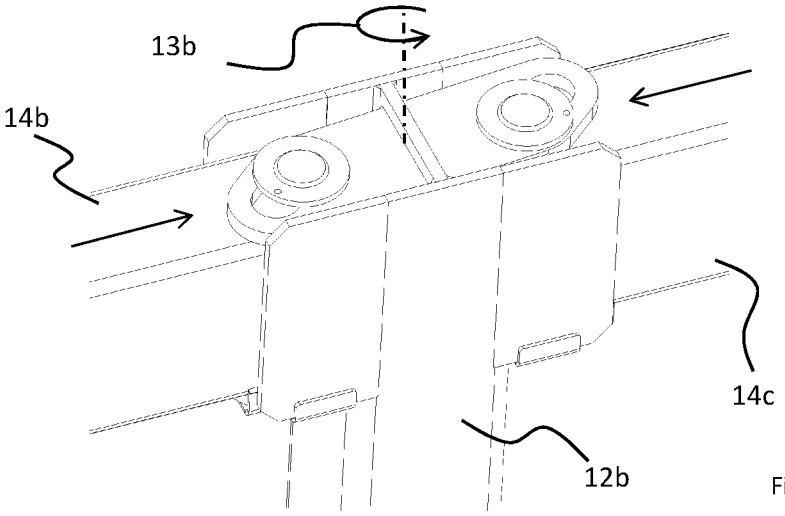

As can be best seen in any of FIGS. 4A to 4C, the barrier 10 may comprise an articulating link 24. The articulating link 24 may be used to connect the first beam 14*a* and the second beam 14*b* such that it translates a longitudinal movement of the first beam 14*a* in a first direction 20, to a longitudinal movement of the second beam 14*b* in a second direction 22. In doing so, the force of an impact may be partly distributed along the beam 10 to help absorb some of the impact energy.

The first direction 20 and the second direction 22 may be in alignment with the beams 14*a,b* but in opposing directions. Thus, the movement of the first beam 14*a* towards a post 12 in a first direction 20, may result in the second beam 14*b* also moving towards the post in an opposing second direction 22. Similarly, the first beam 14*a* moving away from the post 12 in the second direction 22, may result in the second beam 14*b* moving away from the post 12 in the first direction 20.

It will be appreciated that the designations of first 20 and second 22 direction are chosen arbitrarily to differentiate the two directions but these may be interchanged and or other designations used. For example, the directions may be referred to collectively as inwardly or outwardly in relation to the post. Thus, the first beam 14*a* and second beam 14*b* may be referred to as simultaneously moving inwardly towards the post 12, or outwardly away from the post 12.

The articulating link 24 may be used to connect the first beam 14*a* and the second beam 14*b* such that a lateral impact force on a beam may be translated from a longitudinal movement of the first beam 14*a* in a first direction 20 into a longitudinal movement of the second beam 14*b* in a second direction 22. In doing so, the force of an impact may be partly distributed along the barrier 10 to absorb some of the energy and reduce stress concentrations on the posts 12 and/or beams 14*a,b* local to the impacted beam. The articulating link 24 may be attached to the beams 14*a*, 14*b* such that a linear motion of one of the beams, e.g. the first beam 14*a*, rotates the articulating link which in turn moves the other beam, e.g. the second beam 14*b*, linearly in the opposite direction.

Figure 3:
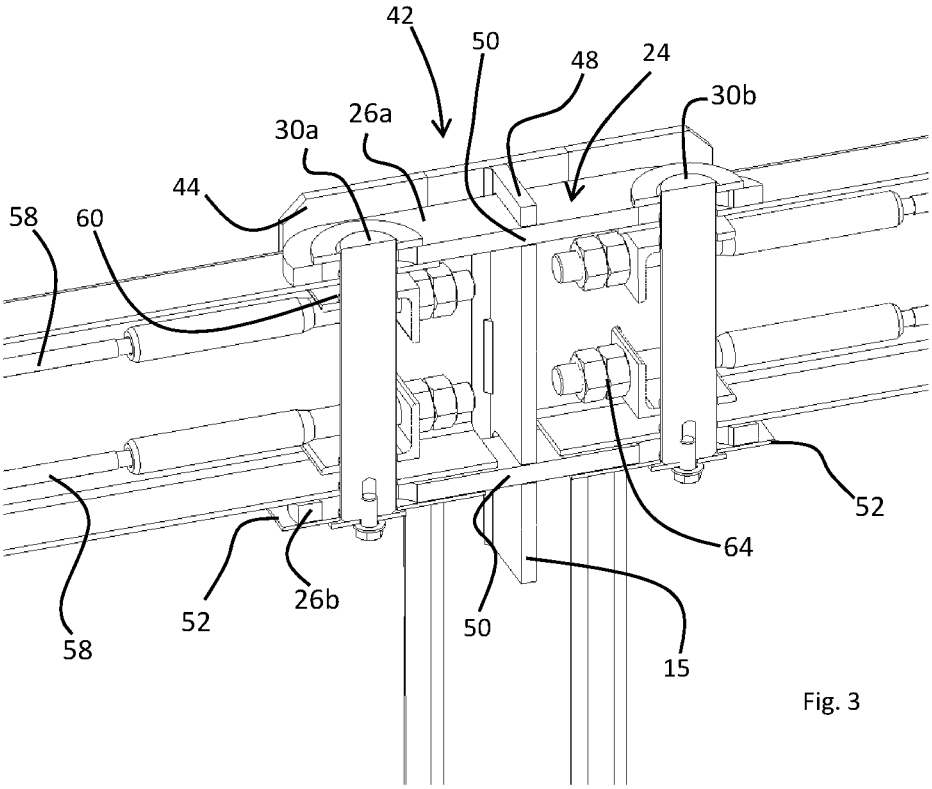
FIG. 3 shows a partial cross section of a barrier.

The articulating link 24 may be provided by one or more connection members which may be in the form of connection plates 26 which are coupled to each of the beams 14a, 14b by a respective runner arrangement which allows the translation of the beam's linear motion to the rotation of the articulating link 24. Thus, as can be seen in FIGS. 4A-C, there may be provided a connection plate 26 which bridges between the first and second beam 14*a*, 14*b*. In this instance the connection plate 26 is provided on an upper surface of the beams 14*a*, 14*b*, but a similar plate 26 may be provided on one or more of the other surfaces in addition to or as an alternative to the plate on the upper surface, as shown in the section of FIG. 3. The connection member may comprise a plate or some other form of connecting member such as a rod, box section, tube or spar for example. The connection plates 26 may be provided with one or more reinforcement members along the length thereof.

As shown in the figures, the connection plate 26 may be an elongate planar member having a major longitudinal axis which is broadly aligned with the longitudinal axis of the beams, a minor axis across the width when viewed from above and a thickness. The dimensions and material of the plate may be selected of the required mechanical performance required to translate the large amounts of force experienced during an impact.

The width of the connection plate 26 may be less than the width of the beams 14*a,b* such that there is sufficient clearance for the connection plate 26 to rotate about an axis of rotation, in use. The connection plate 26 may be retained by the post 12, either directly or indirectly, so as to be rotatable. The axis of rotation will typically be in the geometric centre of the plate 26 and aligned with the centre of the post 12. However, this may not be the case in some examples and the axis of rotation may be normal to any surface of the beam and/or offset from the centre of the post.

Figure 5:
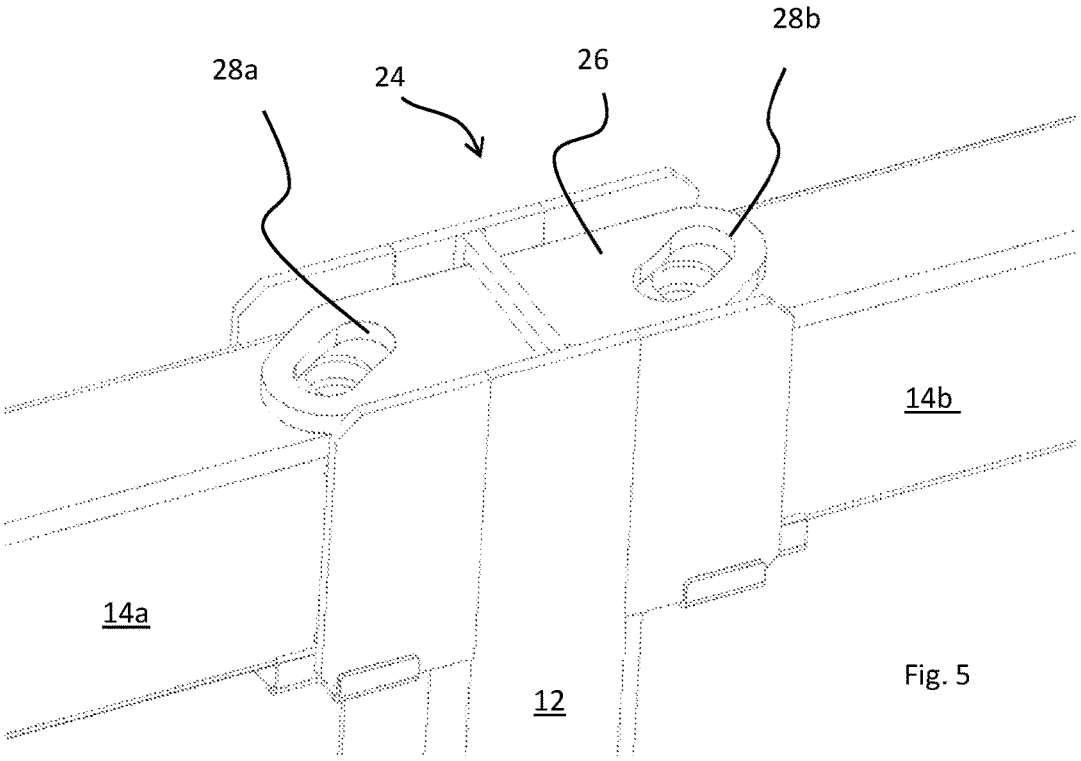
FIG. 5 shows a view of the barrier during an installation process.
Figure 6:
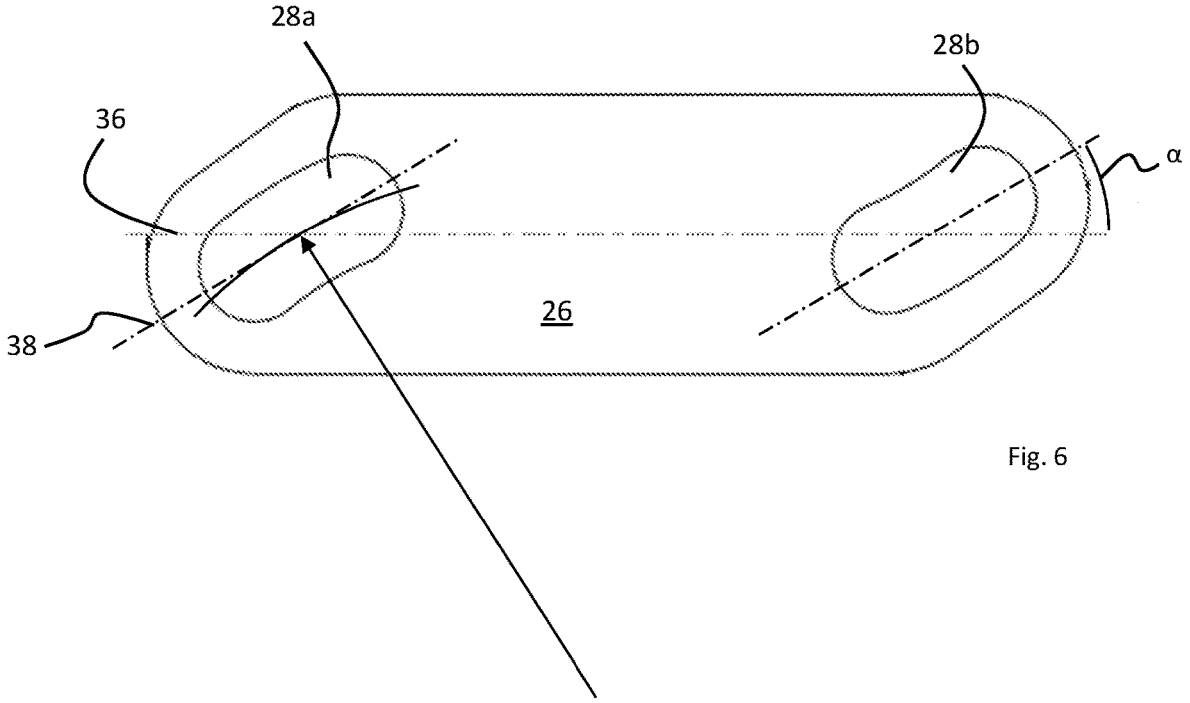
FIG. 6 shows a plan view of a connection plate used in a disclosed articulating link.

As best seen in FIGS. 5 and 6, the connection plate 26 may include a first through-thickness aperture 28*a* and a second through thickness aperture 28*b* through which a respective first connection pin 30*a* and second connection pin 30*b* may pass in order to hold the connection plate 26 against (either directly or indirectly, or adjacent to) the respective beam 14*a,b* and transfer the force from the beam

14*a,b* to the plate 26. The apertures may be longitudinal and straight or curved when viewed in planform.

The connection pins 30*a,b* are displaceable within the apertures 28*a,b* such that they can slide along the length thereof when the beam is moved relative to the post 12 and connection plate 26. More specifically, the apertures 28*a,b* may be elongate and include the longitudinal peripheral edges which provide running surfaces against which the connection pins 30*a,b* abut and slide during a transition from one position to another. The connection pins 30*a,b* may be attached to the respective ends of the beams 14*a,b*. Thus, the first 14*a* and second 14*b* beams are connected to each other via the connection pins 30*a,b* and one or more connecting plate 26 which is free to rotate upon longitudinal movement of either of the first 14*a* or second beam 14*b*.

The apertures 28*a,b* may extend transversely to the longitudinal axis 36 of the plate and/or beams so as to be inclined at an angle α thereto when viewed in planform, as indicated by dashed line 38 in FIG. 6. The inclination of the apertures 28*a,b* to the longitudinal axis 36 may be predetermined to provide a suitable amount of gearing for the movement and translation of the force from one beam 14*a,b* to another. In the example show, the inclination of the slot is approximately 35 degrees but other angles may be used. The angle, size and shape of the running portions of the aperture which contact the connection pins 30*a,b* may be the same for each side of the connection plate 26 such that the connection plate 26 has two fold rotational symmetry.

In addition to being inclined, the apertures 28*a,b* may be curved in the longitudinal direction so as to provide curved running surfaces against which the connecting pins can travel during a transition between a first and a second position. The curvature of the apertures may provide a kidney shaped profiled when viewed in planform. The curved running surfaces may aid the contact between the connecting pin and slot and help transfer the movement of the first beam into the rotation of the connection plate and subsequent movement of the second beam. The curved slot may help to reduce any longitudinal sliding of the connection plate relative to the pins.

The apertures may be arrange to limit the longitudinal travel of the connecting pins. The apertures may provide an upper and lower limit of travel for the connecting pins. The upper and lower limits may respectively relate to a proximal and distal position relative to the post. Hence, in one example, the connecting pin may reside at a nominal or neutral location and be configured to move towards the post by a first distance, and away from the post by a second distance. The first and second distances may be defined by the distal and proximal limits of the aperture. The neutral position of the connecting pins may be located lengthwise in the centre of the apertures such that the distal and proximal distances are the equidistantly disposed from the connecting pin when in the neutral position. In addition, the neutral position of the pin may be located at a predetermined distance from the centre of the post. The distance may be between 100 mm and 300 mm. In one example, the distance may be between 150 mm and 250 mm.

As will be appreciated, each of the connecting pins on either side of the post will have a respective corresponding neutral positon. The respective neutral positions may be equidistant from the centre of the post.

The longitudinal travel of the connecting pin relative to the plate may be between 10 mm and 100 mm. In one example, the longitudinal travel may be between 20 mm and 80 mm. In another example, the longitudinal travel may be between 30 mm and 60 mm. It will be appreciated that the longitudinal travel may be defined by the addition of the distal and proximal travel.

The curvature of the slot(s) may be provided by a constant radius. The radius of the curved slot may be defined neutral position of the connecting pin and proximal and distal limits of travel from the centre of the plate, in combination with the amount of required rotation of the plate. In one example, the rotation may be between +/−3 degrees to +/−10 degrees. In another example, the rotation may be between +/−5 and +/−7 degrees. Thus, in one example, each end of the opposing beams may have a connecting pin located at a neutral positon which is 205 mm from the centre of the post. The distal limit may be 235 mm from the centre of the plate. The proximal limit may be 175 mm from the centre of the plate. The angle of rotation about the centre of the plate may be +/−5 degrees. Such an arrangement may provide 30 mm of movement in either direction at a full rotation. It will be appreciated that these constraints may be application specific.

It will be appreciated, that the larger the angle of the chord of the curved slots relative to the longitudinal axis of the beams, the greater the resistance to the movement of the plate(s) and the less longitudinal transition is available.

The operation of the articulating link 24 and movement of the beams 14*a*, 14*b* is best shown in FIGS. 4A-4C, which is described below. FIG. 4A shows the beams 14*a,b* in a nominal or neutral position in which there has been no relative movement from a first position to a second position. Thus, the articulating link 24 and connection plate 26 is shown as being aligned with the longitudinal axes of the beams 14*a*, 14*b*. In FIG. 4B, the first beam 14*a* has been moved from a first position to a second position in a direction away from the post 12. This movement results in the rotation of the connection plate 26 in a first rotational direction 13*a* and the resultant simultaneous driving away of the second 14*b* beam from a corresponding first position to a second position. In FIG. 4C, a beam 14*b* has been moved towards the post 12*b* from the first or second position to a third position which results in the rotation of the connection plate in the opposite rotational direction and the simultaneous movement of the other of the opposing beam 14*c* into a corresponding third position.

It will be appreciated that, where a plurality of the disclosed beam connections are used in a barrier 10 along a line of adjacent posts, the movement of a first beam 14*a* in a barrier system will result in a cascade of movements along the line of beams 14*a,b,c*. In addition, the movement of the beams will be reversed at each post along the line. In one example barrier there may be a first post 12*a* connected to a first beam 14*a* and a second beam 14*b*, and a second post 12*b* connected to the opposing end of the second beam 14*b* and a third beam 14*c*, as shown in FIGS. 4B and 4C. Upon a vehicle impact, the deflection of the first beam 14*a* may result in the first beam 14*a* moving away from the first post 12*a* in the first direction 20. As a consequence, the second beam 14*b* may be moved away from the first post 12*a* in the second direction 22 and towards the second post 12*b*. The movement of the second beam 14*b* towards the second post 12*b* will cause the third beam 14*c* to move towards the second post 12*b*, and away from a third post (not shown), and so on down the line. The same will occur in the posts on the opposing side of the first beam 14*a*. The movement of the beams 14*a,b,c* along the line in this fashion allows the energy from an impact to be distributed along the line which can help prevent mechanical failures at the post on either side of an impacted beam. Hence, the articulating links distribute energy from an impact along the barrier.

As can be seen from FIGS. 4A-4C, the articulating link 24 is arranged to rotate about a central axis which, in the example shown in the figures is co-axial with the central axis of the post 12. This rotation drives the connecting pins 30*a,b* along the slots 28*a,b* provided in the connection plates 26 and causes the opposing movement of the beams.

In some examples, the articulating link 24 may comprise a first connection plate and a second connection plate. The first and second connection plates may be arranged on opposing sides of the beams and share common connection pins for each of the first and second beams. Thus, the articulating link 24 may include a pair of plates. In such a case, the connection plates may be identical to one another but this is not necessarily so and they may differ.

Figure 2:
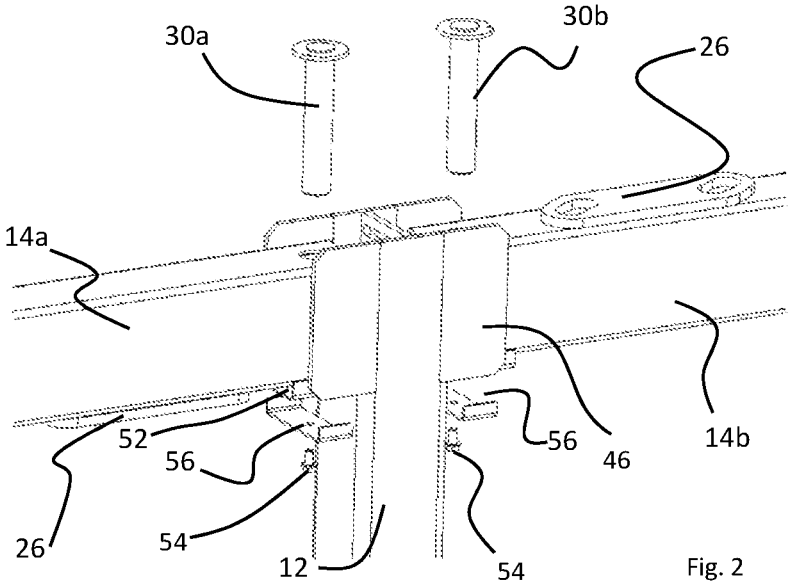
FIG. 2 shows an exploded view of a portion of a barrier

Referring to FIGS. 2 and 3 there is shown an example of a beam and post connection assembly of a barrier. Thus, there is shown a post 12, the terminal end of a first beam 14*a*, the terminal end of a second beam 14*b* and an articulating link 24. The arrangement shown in FIGS. 2 and 3 may be employed in the barrier shown in FIG. 1.

The post 12 may be a vertical member extending from a suitable ground fixture as shown in FIG. 1. The cross-sectional profile and material of the post 12 may be chosen to provide a suitable amount of resilience and rigidity for inhibiting the progression of a vehicle in an impact event. As best seen in FIG. 2 (and FIG. 4A-C), the post 12 may be generally square in section and comprise an external wall which defines a hollow interior. However, the post may take other forms and have a different sectional profiles, such as round or oval. In some instances, the post 12 may be provided by a vertically oriented H-beam in which the cross member of the H lies perpendicular to the barrier line, for example. The post 12 may include lateral sidewalls located on either side of the post and facing away from the line of the barrier and may also include inline sidewalls which face along the line 10*a* of the barrier.

As can be seen in the sectional view of FIG. 3, a hollow post 12 may include one or more reinforcement members 15 such as a web, flange, rib or other strengthening features which may be provided within the hollow core of the post 12.

The distal end of the post 12 may terminate in a beam receiving portion 42. The beam receiving portion 42 may take any suitable form which can receive and retain the respective ends of the first 14*a* and second 14*b* beams. The beam receiving portion 42 may be provided by one or more apertures, walls, plates, flanges sockets or webs, for example, against which the beams can be located and/or fixed. The beam receiving portion 42 may comprise a sleeve or socket into which the terminal ends of the beams can be slidably received. The sleeve or socket may fully or partially enclose the terminal end of the first 14*a* and second 14*b* beam.

The beam receiving portion 42 may include opposing laterally disposed sidewalls 44, 46 which extend in a vertical plane and along the length of the beams 14*a,b* so as to flank the sides of the beams and face away from the line of the barrier 10. The sidewalls 44, 46 may form part of or be an extension of the lateral sidewalls of the post 12. The lateral sidewalls 44,46 of the beam receiving portion 42 are separated by a gap in which the terminal ends of the beams 14*a,b* can be received.

The lateral sidewalls 44, 46 may be bridged by a web 48 which partitions the beam receiving portion 42 into a first socket for receiving the terminal end of the first beam 14*a*, and a second socket for receiving the terminal end of the second beam 14*b*. Each socket may comprise a pair of opposing sidewalls and an end plate in the form of the web. Thus, when viewed from above, the profile of the beam receiving portion 42 may be H-shaped, with the cross member providing the partitioning web 48. The beams 14*a,b* may terminate proximate to the web such that they are embedded within the walls of the post as far as possible without fouling on the web during installation and normal in service use. It will be appreciated that the separation of the beam ends will be predominantly determined, or at least limited, by the dimensions of the articulating link 24.

One role of the lateral sidewalls 44, 46 is to laterally restrain the movement of the beam during an impact event. During an impact event when the barrier 10 is struck by a vehicle (nominally represented by oval 32 in FIG. 1), the force of the vehicle 32 will urge the beam laterally away from the line of the barrier 10 and posts 12 as indicated by arrow 34. In order to prevent the shear lateral movement the lateral sidewalls 44, 46 may abut or mate with corresponding surfaces or features on the beams 14*a*, 14*b*.

The length of the lateral sidewalls 44, 46 along the length the first and second beams 14*a,b*, may be any determined to provide the necessary lateral restraint without failing during an impact event. Thus, the lateral sidewalls 44, 46 of the receiving portion 42 may be greater than the width of the post 12. In the example shown in the figures, the lateral sidewalls may be provided by flanges which extend outwardly from the post 12 along the cheeks of the beam.

The fit of the beams 14*a,b* between the sidewalls 44, 46 may be relatively sung whilst leaving sufficient clearance to allow for manufacturing tolerances and operational movements such as thermal expansion.

The receiving portion 42 may comprise walls on either or both of an upper or lower surfaces (not show) to vertically restrain the movement of the first and second beams 14*a,b*. Hence, the receiving portion 42 may include a base which is integrally attached to the post 12 or lateral sidewalls 44, 46 and provides a seat on which the beam can rest. Similarly, the upper extent of the receiving portion 42 may be defined by an upper wall which is integrally attached to the post 12 or lateral sidewalls 44, 46.

In some instances, such as the example shown in the sectional view of FIG. 3 and exploded view of FIG. 2, the vertical restraint may be provided by one or more connection plates 26*a,b* which are slidably received by the post 12 and located below and/or above the beams 14*a,b*. The connection plates 26*a,b* may be received by a rotation support which allows the rotation of the connection plate relative to the post 12. The rotation support may be provided by an aperture 50 which is provided in the central web 48 of the beam receiving portion 42 and prevents or limits vertical movement. The vertical restraints may form part of the articulating link 42 or may be a separate component and be stationary in relation to the post 12 and other components of the receiving portion 42. The vertical restraints and/or connection plates 26*a,b* may be received by some other form of engagement features such as a slot or channel provided in the lateral side walls 44, 46 of the post 12 or beam receiving portion 42.

The aperture(s) 50 which receive the connection plates 26*a,b* may have a shape corresponding to the connection plates 26*a,b*. Thus, the central web 48 or a wall of the post may include one or more elongate slots which are provided in a spaced relation so as to be separated by a gap. The separation of the slots 50 may correspond to the height of the beam such that the beam 14*a,b* can be located between the vertical restraints/plates 26*a,b* when installed. It will be appreciated that there should be sufficient clearance around beam to allow for the required movement.

The articulating link 24 may provide a floating connection of the beams in which there is no direct contact between post and the beams 14*a,b*, with the only indirect contact being via the connection plates 26 which passes through the aperture 50 in the post 12.

As also shown in FIGS. 2 and 3, the beams 14*a,b* may each be provided with a sleeve 52 which receives either the upper or lower connection plate. The upper sleeve is not shown, but the lower sleeve 52 is best seen in FIG. 3. The sleeve 52 may be dimensioned to correspond to the dimensions of the connection plates 26*a,b* so as to be snugly received therein. The sleeve 52 may be provided by a second wall located adjacent to and separated from the respective wall of the beam. The sleeve may be attached to the beam via sidewalls which extend between the second wall and external wall of the beam. The sleeve 52 may include at least one open end to allow the connection plate 26 to be inserted therein.

The connection of the beams 14*a,b* to the post 12 may be achieved with any suitable fixture which prevents the lateral movement of the beams 14*a,b*. This connection may be in addition to or in place of the lateral sidewalls 44, 46 of the beam receiving portion 42.

The attachment of the connection pins 30*a,b* to the respective beams 14*a,b* may be achieved by any suitable means. For example, the pins 30*a,b* may be integrally formed with the beams 14*a,b* or attached via a threaded joint or welding. In the example shown in the figures, as best seen in FIG. 2, the connection pins 30*a,b* may pass through the upper connection plate 26*a*, the terminal end of the respective beam 14*a,b*, the lower connection plate 26*b*, before locked in place with a suitable fixing devices such as a nut or bolt 54.

The arrangement may also include one or more lock plates 56 which attaches to the beam via the connection pin 30*a,b* or fixing device 54 so as to prevent lateral movement of the connection pin relative to the beam and help to keep the connection pin centralised.

In one example, as best seen in FIG. 3, the beam 14*a,b* may comprise a plurality of reinforcement members 58 which extend longitudinally along the beam 14*a,b* between the first and second ends thereof. The reinforcement members 58 may be of any suitable type but will typically comprise a wire rope or cable to aid the restraint of the vehicle during an impact event and help reduce the lateral deflection in the beam 14*a,b*.

As indicated by the mid-plane section of FIG. 3, the beams may be hollow having a plurality of external walls which provide a box section. Thus, there may be upper and lower walls and sidewalls which define a hollow interior. Additionally, there may be a plurality of reinforcement members 58 which are arranged within the beam. There may be one or more reinforcement members 58 located in an upper half of the beam 14*a,b*, and/or one or more reinforcement members 58 located in a lower half of the beam 14*a,b*. In the example of FIG. 3, there is provide an upper pair (of which only one is shown) and a lower pair (also of which only one is shown). Hence, there may be four reinforcement members.

The reinforcement members 54 may be attached to the beams at any appropriate location and by any appropriate means. Thus, the beam 14*a,b* may include one or more end walls, plates, flanges or webs to which the reinforcement members 58 are attached. In the section of FIG. 3, it can be seen that the reinforcement members 58 terminate in carriages 60 which extend laterally across the interior of the beam 14*a,b*. The carriages may be attached to the internal walls of the beam 14*a,b* and/or to the connection pins 30*a,b*. Thus, the reinforcement members 58 may be connected to the post 12 via the carriage 60, connection pin 30*a,b* and connection plate 26*a,b*.

In the example shown in FIG. 3, there are a plurality of carriages 60 with each carriage 60 being attached to two reinforcement members. The reinforcement members 58 are equidistantly spaced from central point through which the connection pin 30*a,b* passes. Thus, the tensile load of the reinforcement members can be equally balanced across the connection pin by the carriage.

The carriages 60 may be provided an elongate member having a vertical face to which the reinforcement members may be attached, and a horizontal face having an aperture through which the connection pin can pass.

The reinforcement members 58 may be attached to the carriage 60 using a tensioning system 64 as shown. Thus, the reinforcement members 58 may terminate in a threaded portion which extends through a hole in the attachment point and receives a nut which may be tightened to achieve a required tension in the cable. The threaded bar is provided as part of a crimped sheath, but other terminations and tensioning systems may be employed.

To help strengthen the attachment between the beams 14*a,b* and the articulating link, the connection pins 30*a,b* may pass through an external wall of the beam 14*a,b*. In some examples, the connection pins 30*a,b* may pass through and attach only to the external walls of the beam 14*a,b*. This may be the case where carriages are not employed and the reinforcement members terminate in an end wall of the beam 14*a,b* or some other suitable attachment point. It will be appreciated that the holes through which the connection pins 30*a,b* pass may be suitably reinforced.

To install the barrier, posts 12 are first mounted in the required position before the beams 14*a,b* are lowered between the lateral sidewalls 44, 46. The lower connection plate 26*b* may then be inserted from a distal end of the first beam sleeve 52, through the rotation support aperture 50 and into the proximal end of the second beam sleeve 52. Next, the upper connection plate 26*b* can be placed on the upper wall of the beam 14*a,b* as shown in FIG. 5. The connection plate can be moved relative to the beams until the apertures 28*a,b* are aligned with the correspond connection pin apertures in the upper wall of the beam 14*a,b*. As the connection plate can be moved in this way, any longitudinal or lateral misalignment of the beams in the sockets due to the placement of the beams or manufacturing tolerances can be accounted for with ease.

Once the apertures are aligned, the connection pins 30*a,b* can be inserted through the upper and lower walls of the beams and the connection plates, prior to the bolts 54 being inserted into the bottom of the connection pins 30*a,b* via the retention plates 56.

In the examples which include the reinforcement members 58, these may be installed within the beams 14*a,b* prior to the assembly. Hence, the carriages 60 may be affixed to the internal walls of the beam 14*a,b* such that the connection pin apertures of the upper and lower wall of the beam 14*a,b* and the carriages 60 are aligned. The carriages 60 may be attached to the walls of the beam 14*a,b* via welding or the like.

Although the beams are generally described as elongate members which extend between adjacent posts in the above disclosure, it will be appreciated that the beam may be a portion of a panel or other structure which extends between two posts. Hence, the beam may be incorporated into a panel or be represented by a panel.

It will be understood that the invention is not limited to the examples and embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A barrier for inhibiting progression of a vehicle, comprising:

a plurality of posts;

a first beam and a second beam arranged in an end-on relation to one another and extending between respective posts of the plurality of posts, wherein the first beam and second beam are longitudinally displaceable with respect to one another; and an articulating link connecting and attached to the first beam and the second beam, wherein the articulating link is configured to rotate to translate a longitudinal, linear movement of the first beam in a first direction to a longitudinal, linear movement of the second beam in a second direction, wherein each of the first beam and the second beam are elongate and have a longitudinal axis and wherein the first and second directions are opposite to one another and along the respective longitudinal axes of the first beam and the second beam.

2. A barrier as claimed in claim 1, wherein the articulating link comprises a connection plate which extends between and is connected to the first and second beam.

3. A barrier as claimed in claim 2, wherein the connection plate is connected to each of the first beam and second beam via a connection pin.

4. A barrier as claimed in claim 1, wherein one or more of the posts include a receiving portion for receiving a terminal end of each of the first and second beams.

5. A barrier as claimed in claim 4, wherein the receiving portion comprises a lateral sidewall against which the respective terminal end of the first and second beam abuts during an impact to prevent a lateral separation of the post and the first and second beams.

6. A barrier as claimed in claim 1, wherein the articulating link comprises a first connection plate and a second connection plate located on opposing sides of the first and second beams.

7. A barrier as claimed in claim 6, wherein the first connection plate is located above the second plate.

8. A barrier as claimed in claim 6 wherein either or both of the first and second connection plate is connected to each of the first beam and second beam via a connection pin and wherein either or both of the first and second connection plate includes an aperture for receiving the connection pin.

9. A barrier as claimed in claim 8, wherein the aperture is elongate having a longitudinal axis which extends transversely with respect to the longitudinal axis of the first and second beam.

10. A barrier as claimed in claim 9, wherein the elongate aperture is curved.

11. A barrier as claimed in claim 1, wherein either or both of the first and second beam comprises a reinforcement member which extends between respective first and second ends of the first and second beams.

12. A barrier as claimed in claim 11, wherein the reinforcement member comprises a wire rope.

13. A barrier as claimed in claim 11, wherein either or both of the first and second beams comprise an exterior wall defining an internal cavity, wherein the reinforcement member is located within the internal cavity.

14. A barrier as claimed in claim 11, wherein the reinforcement member is attached to a carriage located within at least one of the first and second beams.

15. A barrier as claimed in claim 14, further comprising a connection plate connected to each of the first beam and second beam via a connection pin, wherein the connection pin engages with the carriage.

16. A barrier as claimed in claim 15, wherein the carriage is floating so as to be connected to the at least one of the first and second beams only via the connection pin.

17. A barrier as claimed in claim 16, wherein either or both of the first and second beams comprises an additional reinforcement member, and wherein the carriage is attached to the reinforcement member and the additional reinforcement member.

18. A barrier as claimed in claim 1, wherein the posts have a terminal end which is distal to a ground surface and the first and second beams are located towards the terminal end of the respective post.

19. A barrier for inhibiting progression of a vehicle, comprising:

a plurality of posts;

a first beam having a first end and a second beam having a second end, the first and second beams arranged in an end-on relation to one another and extending between respective posts of the plurality of posts, wherein the first beam and second beam are longitudinally displaceable with respect to one another; and an articulating link mounted on a central post and connecting the first end of the first beam to the first end of the second beam, wherein the articulating link is configured to translate a force applied to the first beam at a point distant from the articulating link and causing longitudinal movement of the first beam in a first direction to a longitudinal movement of the second beam in a second direction, wherein each of the first beam and the second beam are elongate and have a respective first and second longitudinal axis and wherein the first and second directions are opposite to one another and along the respective first and second longitudinal axes of the first beam and the second beam.

20. A barrier for inhibiting progression of a vehicle, comprising:

a plurality of posts;

an elongated first beam having a first longitudinal axis and an elongated second beam having a second longitudinal axis, the first and second beams arranged in an end-on relation to one another and extending between respective posts of the plurality of posts, wherein the first beam and second beam are longitudinally displaceable with respect to one another; and an articulating link connecting and attached to the first beam and the second beam, wherein the articulating link is configured to translate a longitudinal movement of the first beam in a first direction away from the articulating link to a longitudinal movement of the second beam in a second direction away from the articulating link when the longitudinal axes of the first and second beams are substantially colinear, wherein the first and second directions are opposite to one another and along the respective longitudinal axes of the first beam and the second beam.

* * * * *